US005586909A

United States Patent [19]

Saba

[11] Patent Number: 5,586,909

[45] Date of Patent: Dec. 24, 1996

[54] SEALING STRUCTURE FOR A PANEL-MOUNTED ELECTRICAL CONNECTOR

[75] Inventor: Toshikazu Saba, Yokkaichi, Japan

[73] Assignee: Sumitomo Wiring Systems, Ltd., Yokkaichi, Japan

[21] Appl. No.: 347,143

[22] Filed: Nov. 23, 1994

[30] Foreign Application Priority Data

Nov. 25, 1993 [JP] Japan ..... 5-067943 U
Nov. 26, 1993 [JP] Japan ..... 5-068073 U

[51] Int. Cl.[6] ..... H01R 13/52; H01R 13/74

[52] U.S. Cl. ..... 439/559; 439/273

[58] Field of Search ..... 439/556, 559, 439/273, 272, 283; 277/198

[56] References Cited

U.S. PATENT DOCUMENTS

| | | | |
|---|---|---|---|
| 3,753,212 | 8/1973 | Yamada et al. | 439/559 |
| 3,941,444 | 3/1976 | Bruni et al. | 439/556 |
| 4,857,007 | 8/1989 | Michaels et al. | 439/283 |
| 5,037,325 | 8/1991 | Wirkus | 439/557 |
| 5,087,213 | 2/1992 | Drapcho et al. | 439/559 |
| 5,112,241 | 5/1992 | Chestnut et al. | 439/559 |
| 5,266,051 | 11/1993 | Chupak | 439/559 |

FOREIGN PATENT DOCUMENTS 1-92081 6/1989 Japan .

*Primary Examiner*—Gary F. Paumen
*Attorney, Agent, or Firm*—Wenderoth, Lind & Ponack

[57] ABSTRACT

A sealing structure for a panel-mounted electrical connector seals fixed and detachable connector housings. A waterproof seal has a double seal structure including inner and outer peripheral side sealing sections surrounding a mounting hole of a panel in which the connector is fitted, for sealing a gap between the detachable connector housing and the outer face of the panel. The sealing structure further includes a subseal sealing a gap between a hood of the fixed connector housing and the detachable connector housing in the inner peripheral side of the waterproof seal. When water flows through a gap between the mounting hole and the hood from the inside of the panel, the subseal prevents the water from invading a gap between the hood and the detachable connector housing.

11 Claims, 7 Drawing Sheets

SEALING STRUCTURE FOR A PANEL-MOUNTED ELECTRICAL CONNECTOR

BACKGROUND OF THE INVENTION

1. Field of the invention

This invention relates to a sealing structure for a panel-mounted electrical connector fitted in a mounting hole formed in a panel.

2. Description of the prior art

FIGS. 7 to 9 illustrate a conventional sealing structure for providing waterproofing between a mounting hole 136 formed in a panel 135 and a panel-mounted electrical connector 130 fitted in the mounting hole 136. The panel-mounted connector 130 having the shown sealing structure comprises a fixed connector housing 131 with a hood 132 and a detachable connector housing 133 fitted in the hood 132. In the mounting of the fixed connector housing 131, the hood 132 of the fixed connector housing 131 is fitted into the mounting hole 136 from the inside of the panel 135 or from the left-hand side as viewed in FIG. 7. A locking piece 134 is then engaged with the edge of the mounting hole 136. 0n the other hand, the detachable connector housing 133 is fitted into the hood 132 from the outside of the panel 135 or from the right-hand side as viewed in FIG. 7. The detachable connector housing 133 is then fixed by a bolt 138 with a grommet 137 covering an opening of the hood 132.

A seal 140 is integrally formed along the outer periphery of the grommet 137 and is disposed annularly along the peripheral edge of the mounting hole 136. The seal 140 has an angular section so as to be pointed toward the panel 135, as shown in FIG. 8. The seal 140 is pressed against an outside seal face 139 of the panel 135 upon attachment of the detachable connector housing 133 to the fixed connector housing 131, whereupon the seal 140 is closely adhered to the seal face 139 with elastic deformation. Thus, since the whole peripheral edge of the mounting hole 136 is surrounded by the seal 140, the outer periphery of the detachable connector housing 133 is isolated from the seal face 139. Consequently, water or the like can be prevented from invading the inside of the panel 135 from the outside thereof through a gap between the mounting hole 136 and the panel-mounted connector 130.

The above-described sealing structure has the following problems. When the seal 140 is closely adhered to the panel 135, the pointed distal end of the seal 140 first undergoes the elastic deformation, and finally the whole seal elastically deforms. Since the seal 140 has the angular section, the elastic deformation thereof is unstable. Accordingly, there is a possibility that the elastic deformation of the seal 140 is not uniform throughout an annular path along which the seal 140 is closely adhered to the panel 135 so as to surround the mounting hole 136. More specifically, the angular distal end of the seal 140 deviates in one part of the path toward the outer peripheral side while as the result of the elastic deformation it deviates in another part of the path toward the inner peripheral side. Consequently, the seal 140 is twisted into a corrugated form in a portion thereof where it is repeatedly deviated alternately to inner and outer peripheral sides. Waterproofing is reduced in that portion of the seal 140.

Furthermore, the seal 140 cannot seal a gap Sa between the peripheral edge of the mounting hole 136 and the hood 132 of the fixed connector housing 131 and a gap Sb between the hood 132 and the detachable connector housing, as shown in FIG. 8. Accordingly, water cannot be prevented from passing through these gaps. For example, water drops due to dew condensation on the inner face of the panel 135, or the left-hand face thereof as viewed in FIGS. 7–9, fall and invade the interior of each connector housing through the gaps Sa and Sb.

SUMMARY OF THE INVENTION

Therefore, an object of the present invention is to provide a sealing structure for a panel mounted electrical connector wherein complete waterproofing can be provided by a sealing member without any specific structure added to the connector.

To achieve the object, the present invention provides a sealing structure for a panel-mounted electrical connector comprising a pair of connector housings fitted into a mounting hole formed in a panel from both sides of the same so that the panel is interposed therebetween and an annular sealing member mounted on the peripheral edge of one of the connector housings and having a plurality of ring-shaped abutting faces.

All the abutting faces may be abutted against and be closely adhered to the same counterpart face or to separate members, respectively. The sealing member is pressed against the counterpart face upon abutment such that the plurality of abutting faces may become a single face, though the sealing member has the plurality of abutting faces at the beginning of abutment.

According to the above-described structure, the abutting faces of a single sealing member are independently subjected to pressure, thereby forming ring-shaped watertight faces. Consequently, waterproofing of the panel-mounted electrical connector can be improved.

Another object of the present invention is to provide a sealing structure for a panel-mounted electrical connector wherein the abutting faces of the sealing member are formed into lamellas for improvement in the waterproofing of the abutting faces.

To achieve the above-described object, the present invention provides a sealing structure wherein the sealing member has a plurality of lamellas each extending toward one side of the panel and the lamella located at the outer peripheral side is inclined so as to spread to the outer peripheral side as the same extends toward the side of the panel. The thickness of the lamella spreading toward the outer periphery may be reduced toward the distal end thereof.

According to the above-described structure, the lamella located at the outer peripheral side is obliquely abutted against the panel face, and the sealing member flexes substantially in a uniform direction. If the lamella is abutted against the panel face perpendicularly thereto, the sealing member repeatedly flexes alternately to the inside and the outside, which results in discontinuously flexed portions. Waterproofing is reduced in the discontinuously flexed portions of the sealing member. However, since the sealing member flexes in the fixed direction in the above-described sealing structure, occurrence of such discontinuously flexed portions as described above can be prevented. Consequently, sufficient waterproofing can be achieved. Furthermore, since the lamella is pressed against the panel face so as to be laid down from the outside around the mounting hole, the lamella is pressed against the panel face with its pressing force increased as the water pressure is increased. Consequently, the invasion of water can be prevented more reliably.

Another object of the present invention is to provide a sealing structure for a panel-mounted electrical connector wherein the labor required for installation of the connector can be reduced.

To achieve the object, the present invention provides a sealing structure wherein the lamella at the outer peripheral side is longer than the lamella at the inner peripheral side.

According to the above-described structure, the outer lamella is first abutted against the panel face. Since the lamella is obliquely abutted against the panel face, the force elastically deforming the sealing member is small. The same force as in the prior art is necessary when the inner lamella is abutted against the panel face. However, since the sealing member has a double sealing structure, the sealing member need not be pressed against the panel face with a particularly large force applied. Consequently, the connector can be installed with a force as large as or smaller than is applied in the prior art and sufficient waterproofing can be achieved.

Further another object of the present invention is to provide a sealing structure for a panel-mounted electrical connector wherein the amount of water or the like invading the connector housings can be reduced.

To achieve the object, the present invention provides a sealing structure wherein one of the connector housings has a cylindrical edge extending through the mounting hole to the opposite side of the panel, the other connector housing is formed into the shape of a cap covering the cylindrical edge of said one connector housing, and the sealing member is closely adhered at an inner peripheral ring-shaped abutting face to the edge face of the peripheral edge of the one of the connector housing and at the outer peripheral ring-shaped abutting face to the peripheral edge of the mounting hole. The abutting face at the outer peripheral side may be flexed outwardly as it extends outwardly.

According to the above-described structure, the sealing member is closely adhered annularly to one side of the panel around the mounting hole, so that water from the outside cannot invade the connector housings through the mounting hole. However, there is a possibility that water drops due to dew condensation a the inside of the panel may fall and invade the connector housings through the mounting hole. However, since the inside connector housing projects from the mounting hole and is caused to closely adhere to the inner abutting face of the sealing member, invasion of the water due to the dew condensation can be prevented by the inner abutting face of the sealing member.

BRIEF DESCRIPTION OF THE DRAWINGS

Other objects, features and advantages of the present invention will become clear upon reviewing the following description of a preferred embodiment thereof, made with reference to the accompanying drawings, in which.

DESCRIPTION OF THE PREFERRED EMBODIMENT

Figure 1:
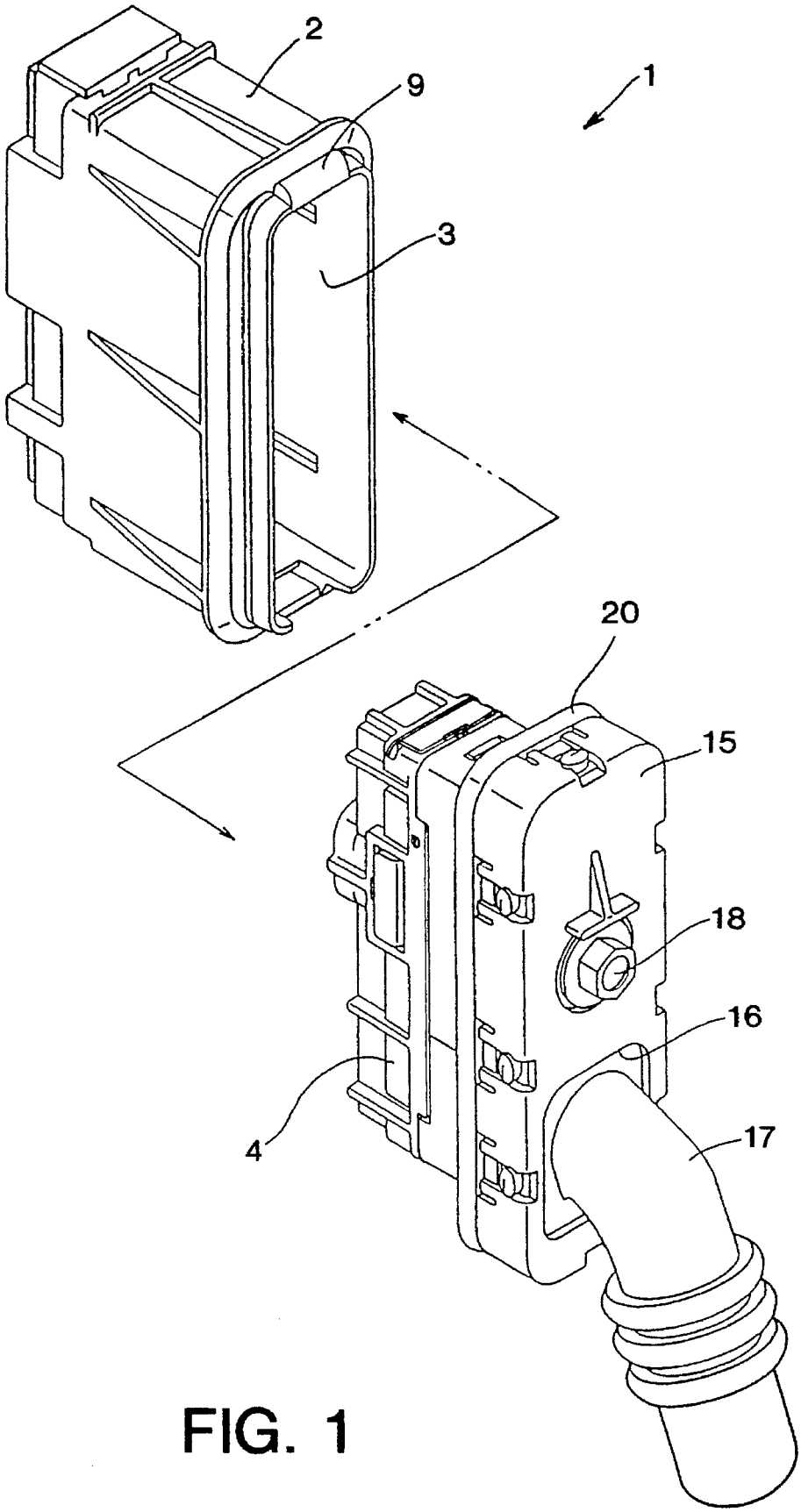
FIG. 1 is an exploded perspective view of one embodiment of a panel-mounted electrical connector in accordance with the present invention.
Figure 2:
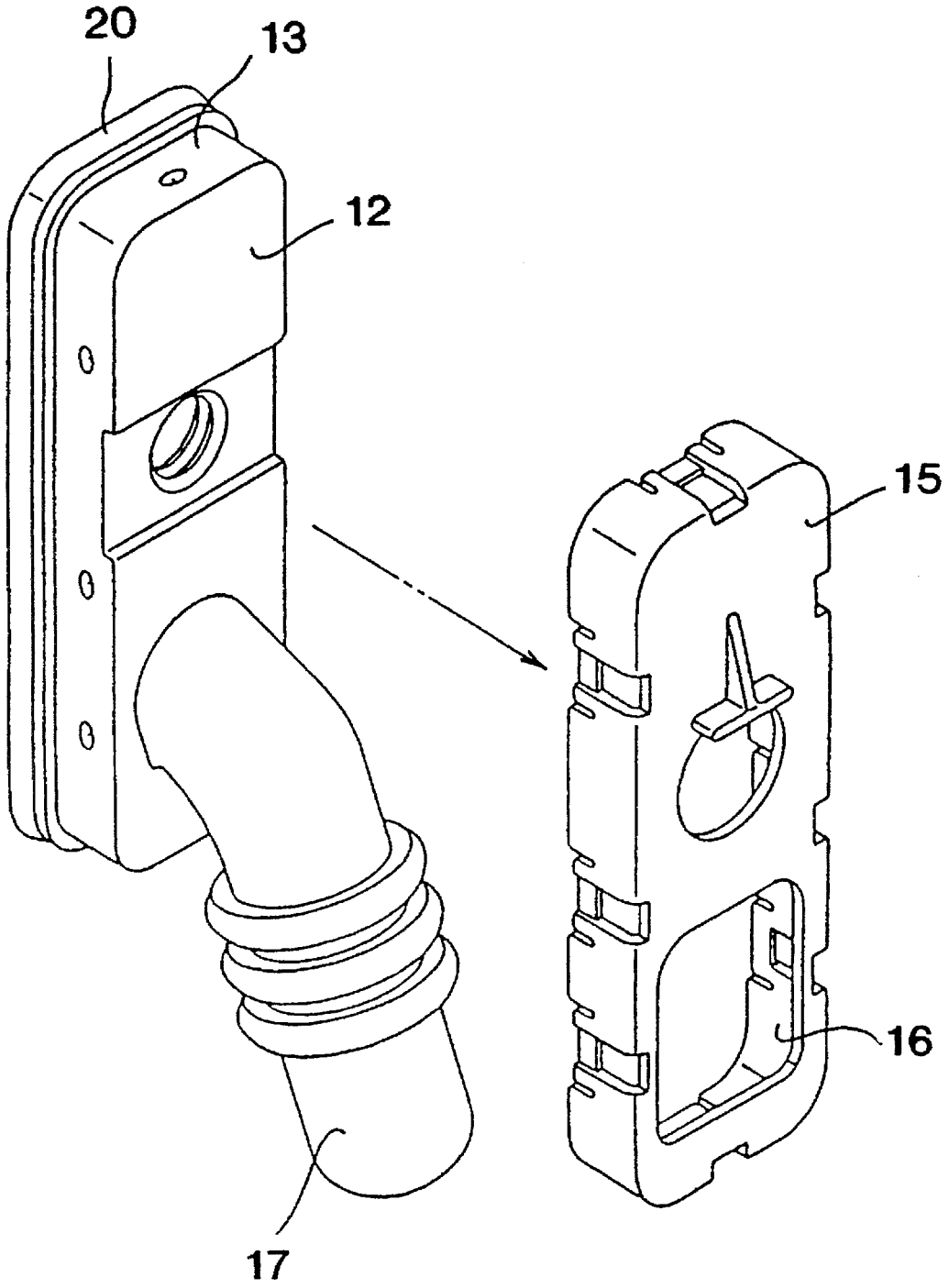
FIG. 2 is an exploded perspective view of a grommet and a grommet cover of the panel-mounted electrical connector.

One embodiment the present invention will be described with reference to FIGS. 1 to 6. A panel-mounted electrical connector 1 of the embodiment comprises a fixed connector housing 2 including a hood 3 having a rectangular section and a detachable connector housing 4 fitted into the hood 3. The connector 1 is to be installed on a panel 5 disposed vertically. The panel 5 has a mounting through hole 6 in which the connector 1 is mounted. The outer peripheral face of the mounting hole 6 or the left-hand face as viewed in FIG. 3 serves as a seal face 7 to which a seal to be closely adhered as will be described later.

The fixed connector housing 2 has therein a plurality of cavities 8 open to the inner end of the hood 3. A plurality of terminals (not shown) are inserted into the respective cavities 8. In the mounting of the fixed connector housing 2, the distal end of the hood 3 is fitted into the mounting hole 6 from the inside of the panel 5 or the left-hand side as viewed in FIG. 3. An engagement portion 9 formed on the upper end of the hood 3 is engaged with the upper edge of the mounting hole 6, and a metal locking piece 10 provided on the underside of the hood 3 is engaged with the lower edge of the mounting hole 6.

The detachable connector housing 4 has therein a plurality of cavities 11 open to the face of its end which is to be fitted into the hood 3. A plurality of terminals (not shown) are inserted into the respective cavities 8. A rectangular plate-shaped rubber grommet 12 covers the face of the detachable connector housing 4 opposite the end to be fitted into the hood 3. The grommet 12 has an outer peripheral engagement portion 13 which is put onto and hooked on an outer peripheral flange 14 of the detachable connector housing 4. A grommet cover 15 is attached to the grommet 12 so as to cover its outer face with a wire harness guide cylinder 17 of the grommet 12 extending through a through hole 16 thereof.

Figure 3:
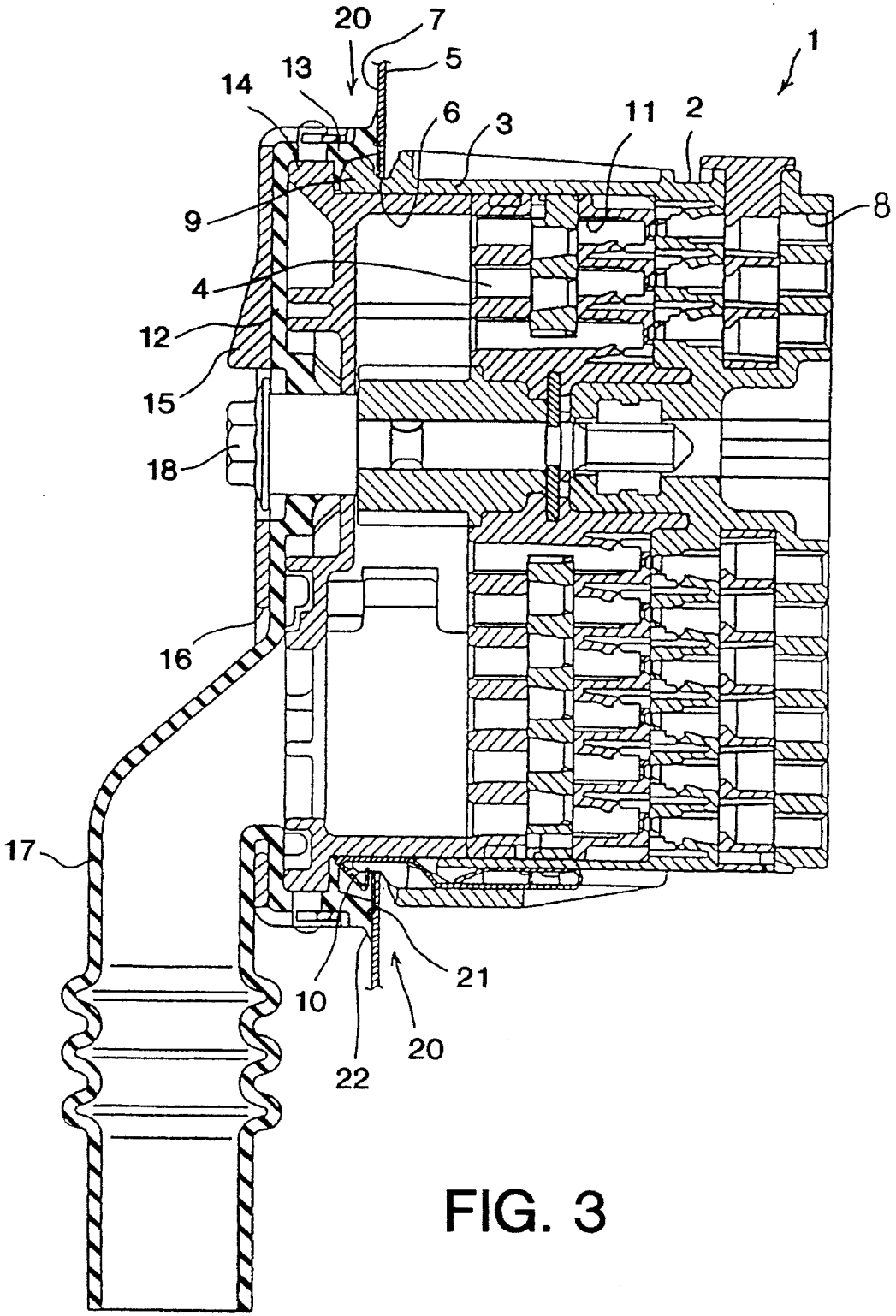
FIG. 3 is a sectional view of the panel-mounted electrical connector fitted in a mounting hole of a panel.

The detachable connector housing 4 is fitted into the hood 3 of the fixed connector housing 2 from the outside of the panel 5 or the left-hand side as viewed in FIG. 3. The detachable connector housing 4 is secured to the fixed connector housing 2 by a bolt 18, whereupon the terminals accommodated in the cavities 8 and 11 of the connector housings 2 and 4 are electrically connected together.

The panel-mounted connector 1 thus mounted on the panel 5 is provided with waterproof means for preventing invasion of water or other liquids to the inside of the panel 5 from the outside of the same, from which outside the detachable connector housing 4 is fitted into the hood 3 of the fixed connector housing 2. The structure of the waterproof means will be described.

The engagement portion 13 is formed on the outer periphery of the grommet 12 for the attachment of the same to the detachable connector housing 4 as described above. The engagement portion 13 has a distal end extending toward the panel 5. The extending portion serves as a waterproof seal 20. The seal 20 is formed into an annular shape so as to surround the periphery of the mounting hole 6 and has a double sealing structure including an inner peripheral side sealing portion 21 and an outer peripheral side sealing portion 22.

Figure 4:
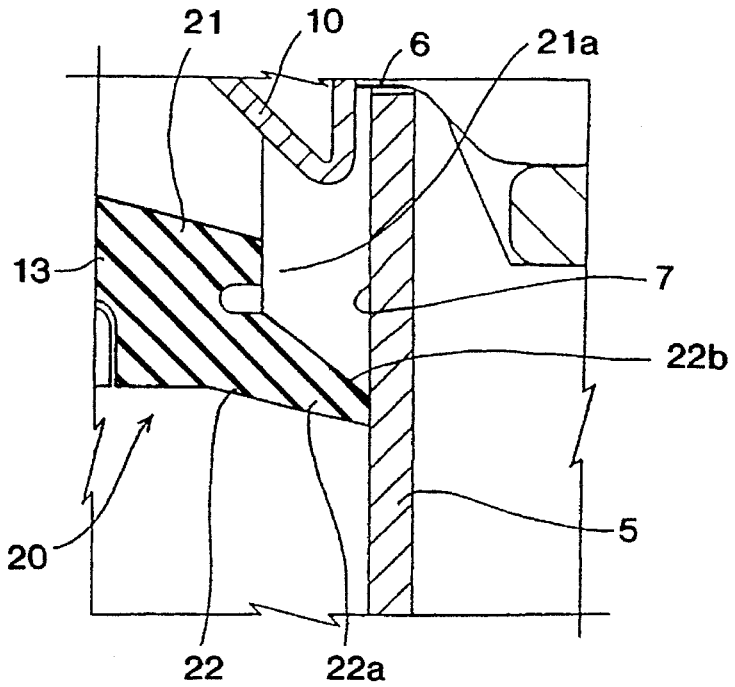
FIG. 4 is an enlarged sectional view of the sealing structure before installation of the connector on the panel is completed.
Figure 5:
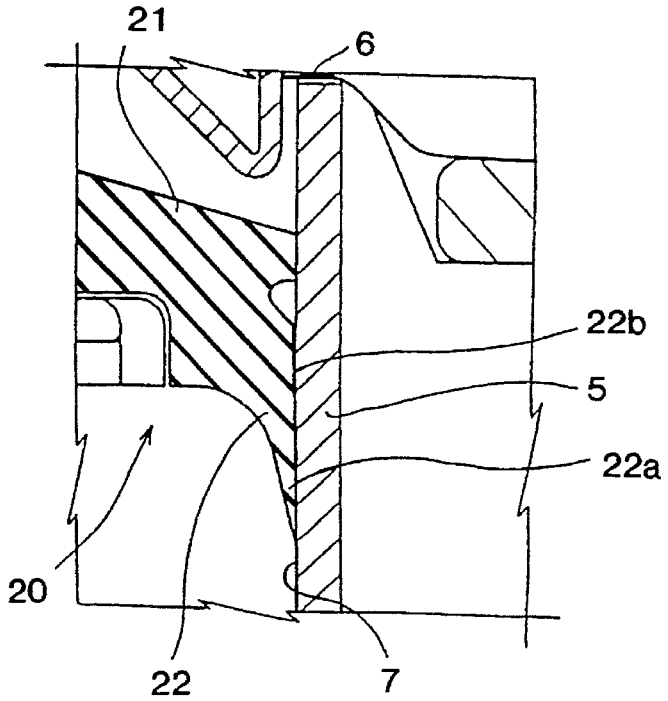
FIG. 5 is an enlarged sectional view of the sealing structure when installation of the connector on the panel is completed.

As best shown in FIG. 4, the inner peripheral side sealing portion 21 has a relatively small length of projection toward the panel 5 and a relatively large thickness. The distal end of the sealing portion 21 extending toward the panel 5 serves as a flat face parallel to the outside face of the panel 5. On the other hand, the outer peripheral side sealing portion 22 has a larger length of projection toward the panel 5 in its free state than the inner peripheral side sealing portion 21. The thickness of the outer peripheral side sealing portion 22 is gradually reduced as it approaches the panel 5. The outer peripheral side sealing portion 22 has a generally wedge-shaped section and is slightly inclined to the outer peripheral side such that it spreads outwardly.

Figure 6:
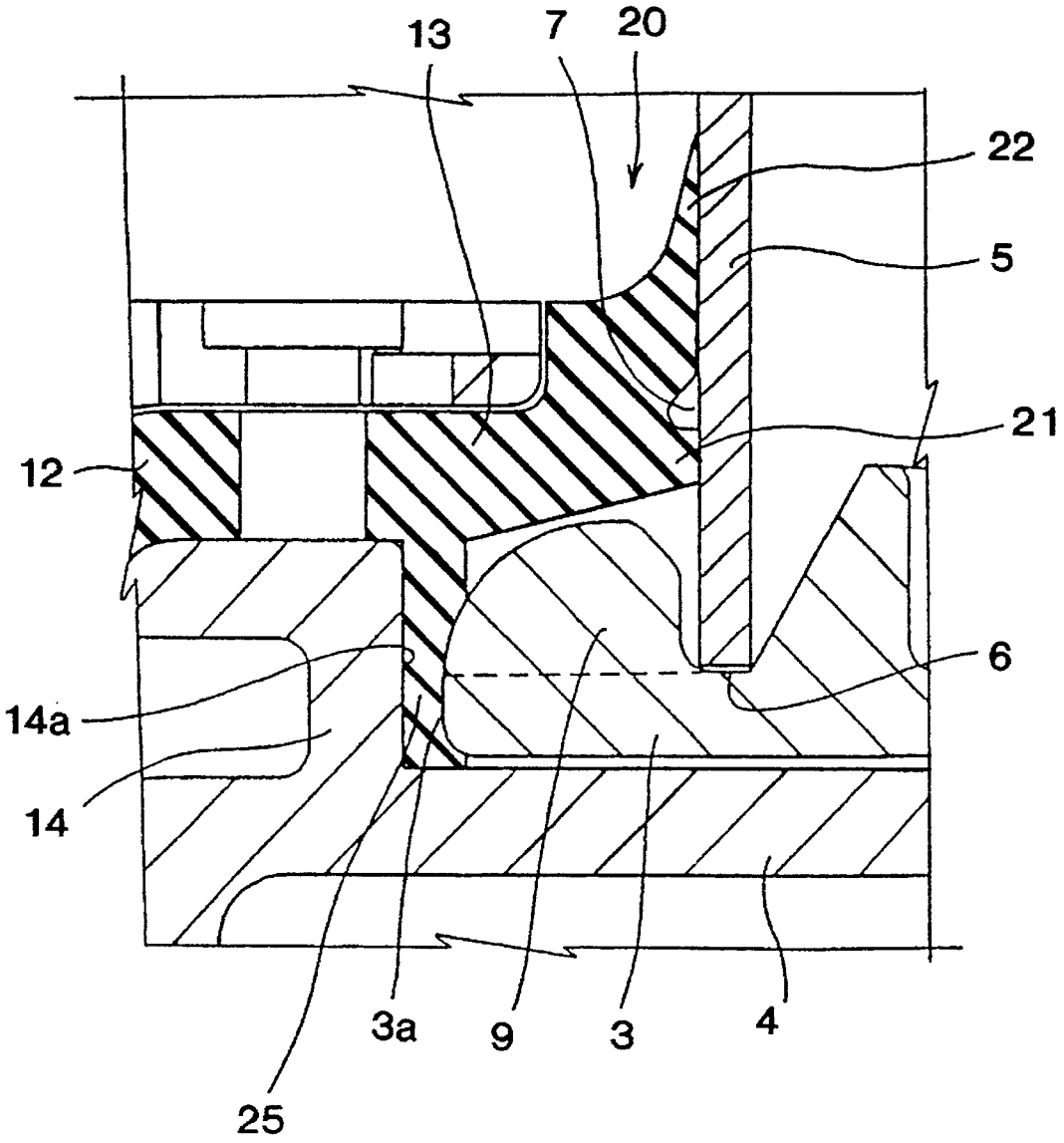
FIG. 6 is an enlarged sectional view of the sealing structure.
Figure 7:
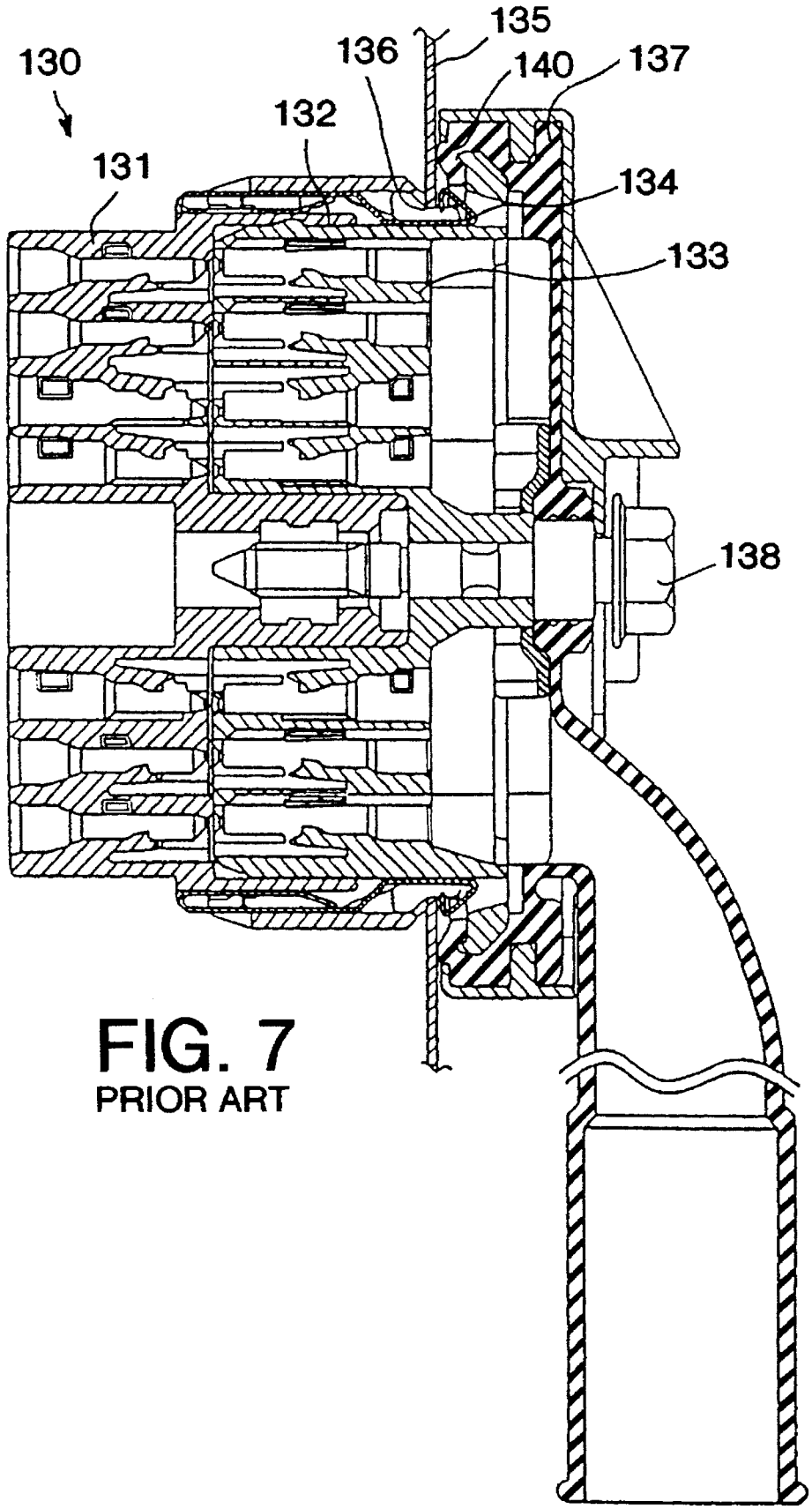
FIG. 7 PRIOR ART
FIG. 7 is a sectional view of a conventional panel-mounted electrical connector.
Figure 8:
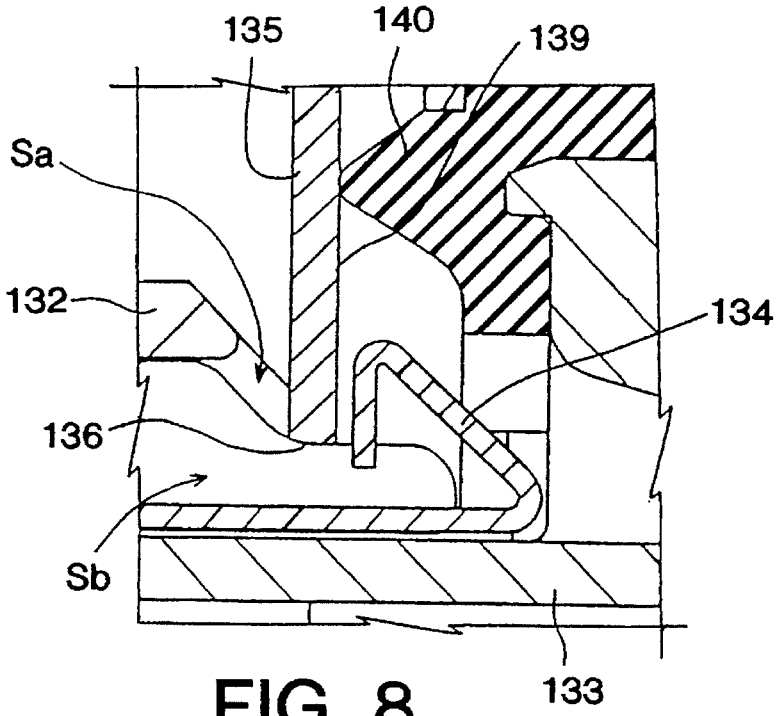
FIG. 8 PRIOR ART
FIG. 8 is an enlarged sectional view of the sealing structure in the conventional panel-mounted connector before installation of the connector on the panel is completed.
Figure 9:
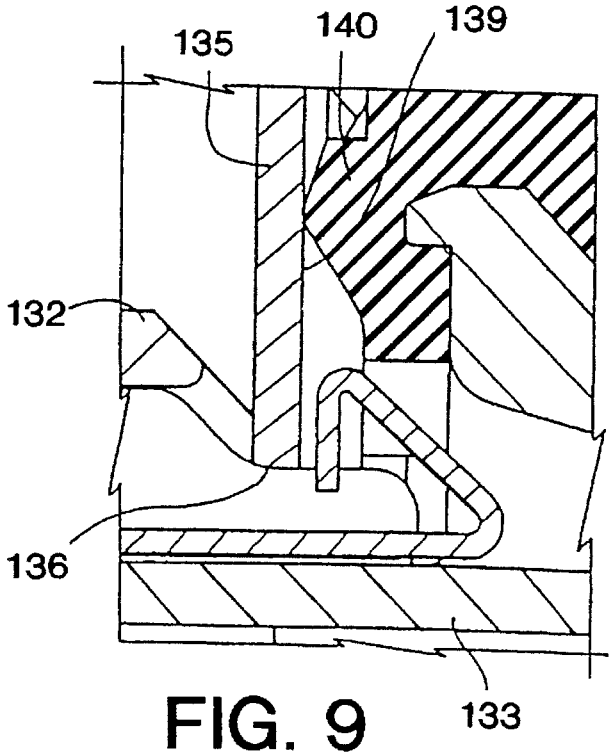
FIG. 9 PRIOR ART
FIG. 9 is an enlarged sectional view of the sealing structure in the conventional panel-mounted connector when installation of the connector on the panel is completed.

The seal 20 includes a subseal 25 providing waterproofing between the fixed connector housing 2 and the detachable connector housing 4, as shown in FIG. 6. The subseal 25 is formed integrally with the seal 20 by extending the engagement portion 13 of the grommet 12 from its overall inner periphery in the form of a plate. The subseal 25 is closely adhered to a front face 14*a* of the flange 14 of the detachable connector housing 4, which front face corresponds to a face 3*a* of the distal end of the hood 3 of the fixed connector housing 2.

The operation of the connector 1 will now be described. With the fitting of the detachable connector housing 4 into the hood 3 of the fixed connector housing 2, the seal 20 is closely adhered to the seal face 7 around the peripheral edge of the mounting hole 6 of the panel 5. In the adherence of the seal 20 onto the seal face 7, an extending end 22*a* of the outer peripheral side sealing portion 22 first comes into contact with the panel 5. As the connector housing 4 is fitted into the hood 3, the outer peripheral side sealing portion 22 is elastically deformed so that the extending end 22*a* thereof is spread out to the outer peripheral side by the panel 5. Finally, the inner 22*b* of the sealing portion 22 is closely widely adhered to the seal face 7. On the other hand, the flat face 21*a* of the inner peripheral side sealing portion 21 is closely adhered to the seal face 7 of the panel 5 with slight elastic deformation accompanied approximately simultaneously with the final adherence of the outer peripheral side sealing portion 22 to the seal face 7.

The inner and outer peripheral side sealing portions 21 and 22 are closely adhered to the seal face 7 of the panel 5 independently of each other with a gap therebetween when the seal 20 is mounted on the panel 5 as described above. The overall peripheral edge of the mounting hole 6 is surrounded by the sealing portions 21 and 22 providing the double sealing, whereupon water or other liquids can be prevented from invading the inside of the panel 5 through the gap between the mounting hole 6 and the connector 1 from the outside of the same. Since the double sealing is provided by the inner and outer peripheral side sealing portions 21 and 22 in the sealing structure of the embodiment, a high level of waterproofing can be achieved.

The outer peripheral side sealing portion 22 spreads out with its extending end 22*a* directed to the outer peripheral side. Accordingly, there is no possibility that the extending end 22*a* flexes to the inner peripheral side. The extending end 22*a* positively flexes, spreading out to the outer peripheral side, and the manner of flexure of the sealing portion 22 is uniform over its entire periphery. Consequently, the waterproofing function is not spoiled as in the portion of the conventional seal where it repeatedly flexes alternately to the inner and outer peripheral sides, and reliable waterproofing can be achieved over the entire periphery of the outer peripheral sealing portion 22. Furthermore, since the thickness of the outer peripheral side sealing portion 22 is gradually reduced to the extending end 22*a* thereof, the sealing portion 22 has a high level of flexibility and is superior in adherence to the panel 5. Consequently, reliable waterproofing can be achieved in this respect.

When the outer peripheral side sealing portion 22 is elastically deformed in the adherence thereof to the panel 5, it is curved with face-to-face contact with the panel 5 but it is not squashed by the panel 5 as in the prior art. Accordingly, the repulsion caused by the elastic return of the sealing portion 22 due to its elastic deformation is weak. When the bolt 18 is tightened for the purpose of assembling the connector housings 2 and 4 and the adherence of the seal 20, the torque borne for the repulsive force from the seal 20 has a small percentage in the screw torque for tightening the bolt 18. Consequently, since the torque borne by the assembling of the connector 1 approximates that required for tightening the bolt 18, the torque for tightening the bolt 18 can be easily controlled in the assembly of the connector 1.

The adherence of the inner peripheral side sealing portion 21 to the panel 5 is maintained eve when the heat from equipment or the like raises the pressure in the inside of the panel 5. Accordingly, airtightness is secured between the inside and outside of the panel 5. On the other hand, even when the pressure is increased from the outside of the panel 5, the outer peripheral side sealing portion 22 is pushed against the panel 5 by the increased pressure. Consequently, airtightness is reliably secured between the inside and outside of the panel 5.

The subseal 25 approaches the end face 3*a* of the hood 3 of the fixed connector housing 2 with the flange 14 upon the fitting of the detachable connector housing 4 into the hood 3. The subseal 25 is held between the front face 4*a* of the flange 4 and the end face 3*a* of the hood 3 when the connector housings 2 and 4 have been completely mated together. Thus, water or other liquids can be prevented from flowing between the fixed and the detachable connector housings 2 and 4 in the inside space sealed by the grommet 12 and the seal 20 from the outside of the panel 5. If water drops are produced by dew condensation or the like, they fall down from the inside face of the panel 5, or the right-hand face as viewed in FIG. 3, flowing through the gap between the mounting hole 6 and the hood 3 and further along the upper face of the hood 3 toward the end of the same. However, the subseal 25 held between the end face 3*a* of the hood 3 and the front face 14*a* of the flange 14 prevents the water drops from invading the connector housings 2 and 4 through the gap between inner face of the hood 3 and the outer face of the detachable connector housing 4. The water drops prevented from invading the connector housings 2 and 4 are collected on the upper face of the hood 3. When reaching a predetermined amount, the collected water falls down along the side faces of the hood 3 and is discharged through the gap between the underside of the hood 3 and the mounting hole 6 to the side of the inner face of the panel 5, or the right-hand face as viewed in FIG. 3.

In the embodiment, a gap is defined between the hood 3 and the locking piece 10 formed in the underside thereof so that the connector housings 2 and 4 intercommunicate therethrough. Even if water invades the connector housings 2 and 4 or the water drops are produced by the dew condensation, the water is discharged through the gap between the locking piece 10 and the hood 3 out of the connector housings 2 and 4.

Although the seal is provided on the detachable connector housing in the foregoing embodiment, it may be provided on the fixed connector housing, instead.

The inner peripheral side sealing portion of the seal may be formed to extend so as to spread out toward the inner peripheral side as the outer peripheral side sealing portion in the foregoing embodiment. The inner peripheral side sealing portion is then pushed against the panel when subjected to pressure from the inner peripheral side. Accordingly, airtightness can be reliably secured.

The metal locking piece independent of the hood is mounted on the same in the foregoing embodiment. A resinous or plastic locking piece independent of the hood may be employed instead. Furthermore, the locking piece may be formed integrally with the hood.

In the panel-mounted connector of the foregoing embodiment the hood has a notch formed the underside surface thereof and the locking piece is mounted in the notch in the foregoing embodiment. The underside of the hood includes a portion to which waterproofing by the subseal is not applied. The present invention may be applied to other types of panel-mounted connectors where in the hood has no such notch in the top thereof, that is, it has a notch in one of the side walls or no such notch. In these types of panel-mounted connectors, there is no possibility that the water invades the interior of each connector housing from the top of the hood. Accordingly, sufficient waterproofing of the subseal can be achieved.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. A sealing structure for a panel-mounted electrical connector comprising:

a panel having a mounting hole therein;

first and second connector housings fitted into said mounting hole formed in said panel from opposite sides of the panel such that said panel is interposed between said first and second connector housings, said second connector housing having a peripheral edge, and said first connector housing having a portion thereof extending through said mounting hole, said portion forming an end face; and an annular sealing member mounted on said peripheral edge of said second connector housing, said annular sealing member comprising a plurality of annular abutting faces abutting one side of said panel and an annular inner seal engaging said end face of said portion of said first connector housing.

2. The sealing structure of claim 1, wherein:

said second connector housing comprises a front face adjacent to said peripheral edge, said front face engaging said annular inner seal on a side thereof opposite to said end face of said portion of said first connector housing such that said annular inner seal is sandwiched between said front face and said end face, whereby said first and second connector housings are sealed to each other such that internal portions thereof are sealed from the exterior thereof by said annular seal.

3. The sealing structure of claim 2, wherein said annular inner seal is a waterproof seal.

4. The sealing structure of claim 1, wherein:

said annular sealing member comprises a plurality of nested lamellas having said plurality of annular abutting faces thereon; and said annular inner seal extends inwardly relative to said plurality of nested lamellas.

5. The sealing structure of claim 4, wherein:

said portion of said connector housing extending through said mounting hole extends such that said end face thereof is spaced further from said face than said plurality of nested lamellas.

6. The sealing structure of claim 5, wherein said plurality of lamellas comprise an outer peripheral lamella that is inclined relative to the one side of said panel so as to spread outwardly as said outer peripheral lamella extends toward the side of the panel and an inner peripheral lamella.

7. A sealing structure for a panel mounted electrical connector, comprising:

a fixed connector housing comprising a plurality of cavities therein for receiving terminals therein, an opening and a hood, said hood comprising a distal end having an engagement portion thereon for engaging a mounting hole of a panel and an end face;

a detachable connector housing adapted to be fitted into said opening of said fixed connector housing, said detachable connector housing comprising a front end having a plurality of openings therein for receiving terminals therein, a rear end opposite to said front end and an annular front face on said rear end facing toward said front end; and an annular sealing member mounted on said front end, said annular sealing member comprising a first sealing portion adapted to engage the panel having the mounting hole therein around the mounting hole and a second sealing portion engaging said annular front face and adapted to seal with a waterproof seal said fixed connector housing and said detachable connector housing when said detachable connector housing is inserted into said opening of said fixed connector housing by engaging said end face of said fixed connector housing so as to be sandwiched between said end face and said annular front face of said detachable connector housing.

8. The sealing structure of claim 7, wherein said first sealing portion comprises a plurality of nested lamellas having a plurality of annular abutting faces thereon and said second sealing portion comprises an annular inner seal that extends inwardly relative to said plurality of nested lamellas.

9. The sealing structure of claim 8, wherein said plurality of lamellas comprise an outer peripheral lamella that is inclined outwardly so as to spread outwardly as said outer peripheral lamella extends toward and engages the side of the panel when said detachable connector housing is inserted into said fixed connector housing, and an inner peripheral lamella.

10. The sealing structure of claim 9, wherein said inner peripheral lamella has a flat abutment surface thereon.

11. The sealing structure of claim 7, wherein said end face of said hood and said annular front face are substantially the same size and face toward each other.

* * * * *